US005348509A

United States Patent [19]

Riccardi et al.

[11] Patent Number: 5,348,509

[45] Date of Patent: Sep. 20, 1994

[54] FLYING DISK TOY

[76] Inventors: Victor Riccardi, 251 Knickerbocker Ave., Stamford, Conn. 06907; Arnold Fassman, 40 Oak St., Westport, Conn. 06880

[21] Appl. No.: 79,898

[22] Filed: Jun. 22, 1993

[51] Int. Cl.[5] ..... A63H 27/00

[52] U.S. Cl. ..... 446/46; 446/475

[58] Field of Search ..... 446/46–48, 446/475; 273/424, 425, 428; D21/86, 85

[56] References Cited

U.S. PATENT DOCUMENTS

| | | | |
|---|---|---|---|
| 3,109,256 | 11/1963 | Dean | 446/46 |
| 3,508,360 | 4/1970 | Williams | 446/46 |
| 3,959,917 | 6/1976 | Dawson | 446/48 |
| 4,157,632 | 6/1979 | Everett | 446/46 X |
| 4,184,284 | 1/1980 | Rogahn | 446/48 X |
| 4,274,591 | 6/1981 | Sunshine et al. | 446/211 X |
| 5,277,641 | 1/1994 | Gable et al. | 446/46 |

*Primary Examiner*—Mickey Yu

*Attorney, Agent, or Firm*—Martin D. Wittstein

[57] ABSTRACT

A flying disk toy is disclosed which includes a generally flat, circular body member surrounded by a radially curved annulus, such as in a typical FRISBEE TM toy, and which includes a liquid reservoir on the body member, and endless conduit around the body member in the curvature of the annulus, conduits connecting the reservoir to the endless conduit, and a plurality of pairs of radially aligned apertures in the endless conduit and the annulus, with the result that liquid stored in the reservoir flows through the radially extending conduits into the endless conduit and out through the radially aligned opening in response to centrifugal force imposed on the liquid by a spinning motion imparted to the disk toy when it is thrown into a flight pattern.

4 Claims, 2 Drawing Sheets

FLYING DISK TOY

BACKGROUND OF THE INVENTION

The present invention relates generally to the field of flying disk toys, and more particularly to a flying disk toy which sprays water or other liquid into the air during flight.

It has long been well known that children, teenagers and young adults find great pleasure in throwing various objects into the air which have aerodynamic characteristics that cause the objects to assume some manner of flight pattern. Perhaps for centuries people have thrown relatively flat, disk shaped rocks over calm water to see how far the rocks would fly and how many times they would skip along the surface of the water. Model airplane gliders have been a perennial favorite with children for well over half a century, and more industrious children have fashioned various forms of simulated aircraft from paper and taken great pleasure in watching them fly. In more recent memory, the well known FRISBEE flying disk has been extremely popular with people of all ages due to the unusually great distance the disk covers when thrown into the air vigorously and with sufficient circular motion. Many people have devised games and held contests of speed, distance and aerobatics to enhance the enjoyment of playing with this device.

The quest is endless to devise new and different forms of flying objects for the delight of children and adults, particular those that can perform an ancillary function to merely flying, such as dropping objects, creating bubbles, ejecting separable flying objects, etc. Such functions greatly enhance the enjoyment from watching a device fly, and are particularly fascinating for children.

One of the drawbacks of prior art devices incorporating these ancillary functions is that they tend to be relatively complex, and therefore often too difficult for young children to manipulate and also costly. These factors tend to deter parents from purchasing these device for their children, to the obvious detriment of the children. Thus, there is a need for an extremely simple and inexpensive flying disk toy that will appeal to young children and yet be within their mechanical ability to manipulate and be sufficiently inexpensive that the cost is not a material factor a parent's decision to purchase the device for his children.

SUMMARY OF THE INVENTION

The present invention seeks to provide a flying disk toy which obviates or overcomes the foregoing disadvantages of prior art flying disk toys in a unique and effective manner so as to provide children with an extremely simple and inexpensive toy having an ancillary function for enhanced enjoyment.

In its broader aspects, the present invention is a disk toy adapted to spray a stored liquid into the air as the toy traverses a flight pattern after having been vigorously thrown with a spinning motion imparted thereto, the toy comprising a relatively flat, circular, disk shaped body member having opposite faces and an axially curved annulus surrounding the body member. The device further includes means defining a reservoir for holding a quantity of liquid disposed centrally on the face of the body member surrounded by the annulus. There is an outlet means extending through the curved annulus for permitting liquid to pass through the curved annulus in response to centrifugal force imposed on the liquid in the reservoir defining means from the spinning motion of the body member. Finally, there is means defining a liquid distribution system for distributing liquid stored in the reservoir defining means to the outlet means with the result that liquid is expelled from the disk toy in a circular pattern while the toy traverses the flight pattern.

In some of its more limited aspects, the liquid distribution system comprises an endless conduit disposed in the space defined by the curved annulus and means communicating between the reservoir defining means and the endless conduit. The means communicating between the reservoir defining means and the endless conduit comprises a plurality of radially extending conduits connected to the reservoir defining means and the endless conduit. Further, the outlet means comprises a plurality of pairs of perforations disposed in the endless conduit and the annulus.

Having briefly described the general nature of the present invention, it is a principal object thereof to provide a flying disk toy which alleviates or entirely avoids the disadvantages of prior art flying disk toys and yet provides advantageous features not heretofore known.

Another object of the present invention to provide a flying disk toy which is extremely simple in construction and operation, thereby rendering it very inexpensive to purchase and easy to operate, ever for a small child with little dexterity.

These and other objects and features of the present invention will become more apparent from an understanding of the following detailed description of a presently preferred embodiment of the invention when considered in conjunction with the accompanying drawings.

DETAILED DESCRIPTION OF THE PREFERRED EMBODIMENT

Figure 1:
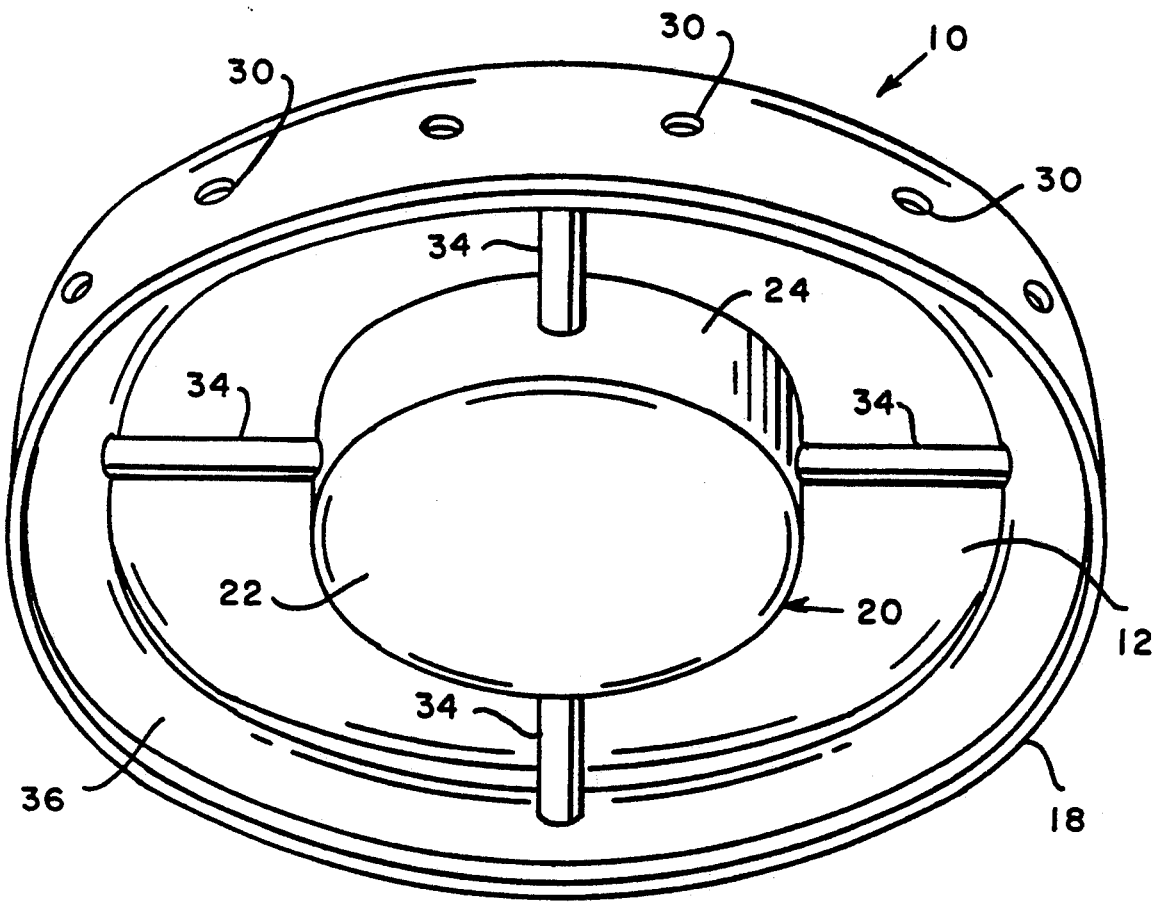
FIG. 1 is a perspective view of the flying disk toy of the present invention, looking toward the underside of the toy at the fluid reservoir and the liquid distribution system.
Figure 2:
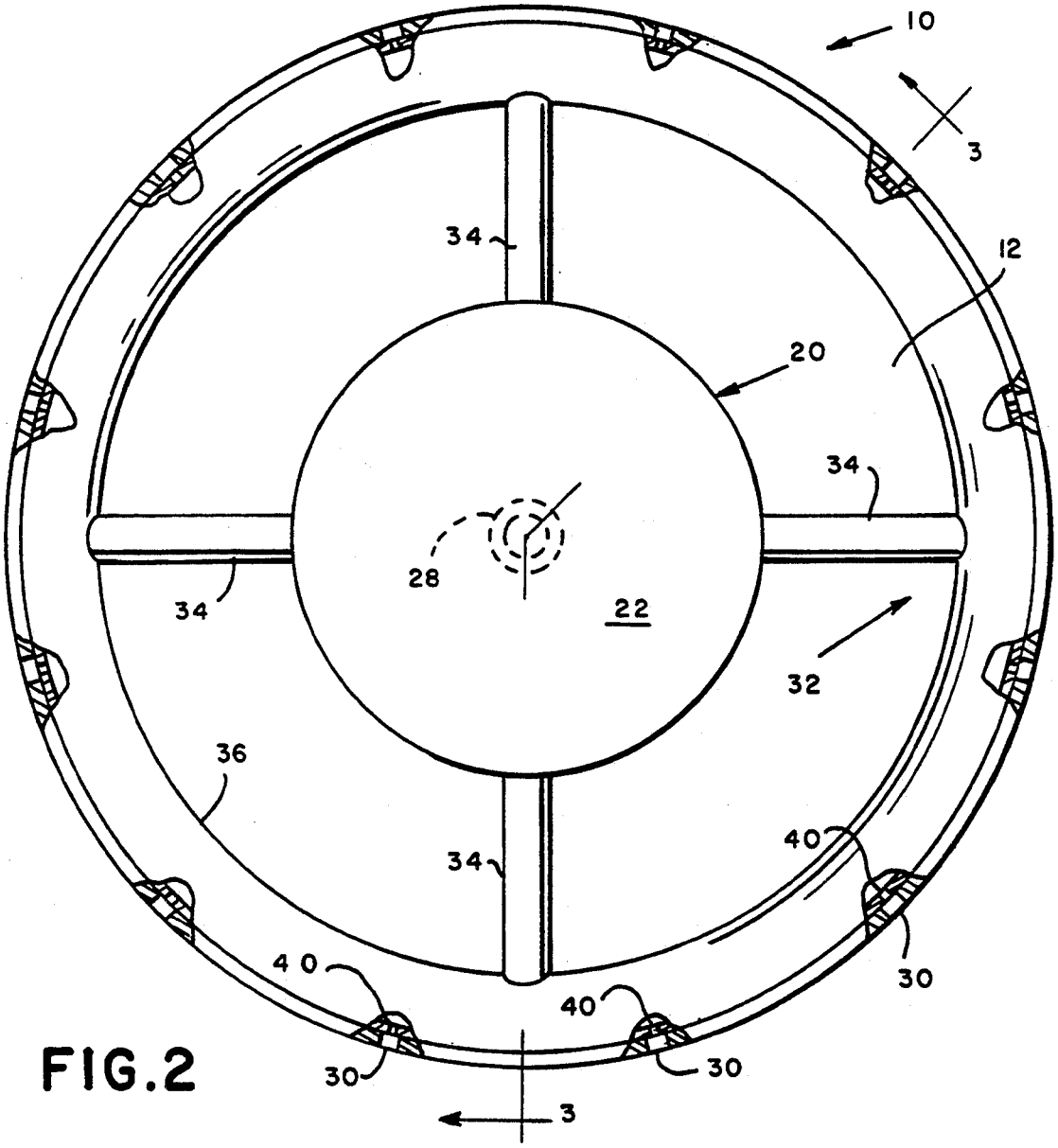
FIG. 2 is a plan view of the flying disk toy of the present invention, looking in the same direction as FIG. 1.
Figure 3:
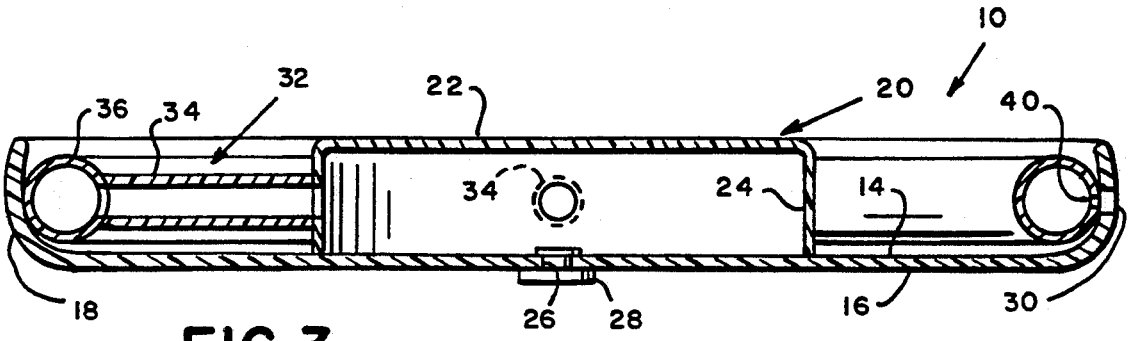
FIG. 3 is a sectional view taken along the angled line 3—3 of FIG. 1.

Referring now to the drawings, and particularly to FIGS. 1 and 2 thereof, the reference numeral 10 generally indicates the flying disk toy of the present invention, which is seen to comprise a body member 12 which is generally flat with a circular configuration and has opposite surfaces 14 and 16, as seen in FIG. 3, the surface 14 being the underside of the toy. The body member 12 is surrounded by an annulus 18 which is curved approximately 90° axially from being coincident with the plane of the body member 12 to being approximately perpendicular thereto. It should be understood that the configuration thus far described is approximate and may vary to some extent, in that the body member 12 need not be absolutely planar, but rather may have a slight curvature imparted thereto; and the curvature of the annulus need not be precisely 90°, but may be a little more or less. Thus, the device 10 has the general configuration and appearance of the well known FRISBEE TM flying disk toy.

The disk toy 10 includes a reservoir generally indicated by the reference numeral 20 for holding a quantity of liquid, the reservoir 20 being of any desired configuration but being shown in the drawings as round and comprising a circular wall 22 spaced from the underside 14 of the body member 12 and secured thereto by an annular side wall 24 so as to form a watertight compartment. The reservoir is filled through a suitable opening 26 formed in the body member 12 within the perimeter of the annular wall 24 and which is sealed by a suitable cap 28.

The annulus 18 is provided with outlet means which comprises a plurality of apertures 30 formed in the portion of the annulus 18 which is generally perpendicular to the body member 12. As will be more fully explained below, the apertures 30 permit liquid to pass through the annulus 18 in response to centrifugal force imposed on the liquid in the reservoir from the spinning motion of the disk toy 10.

The disk toy 10 also includes a liquid distribution system, generally indicated by the reference numeral 32 in FIGS. 2 and 3, which comprises a plurality of conduits 34 which are connected to the reservoir 20 and which extend radially outwardly therefrom. The liquid distribution system also includes an endless conduit 36 which extends around the periphery of the body member 12, and is generally tucked into the curvature of the annulus 18, as best seen in FIG. 3. The radially extending conduits 34 are connected to the inner periphery of the endless conduit 36 so as to be in fluid communication therewith, thereby providing fluid communication between the reservoir 20 and the endless conduit 36.

As best seen in FIG. 2 and 3, the outlet means also includes a plurality of apertures 40 formed in the outer periphery of the endless conduit 36 equal in number to the number of apertures 30 in the annulus 18, and which are radially aligned with the apertures 30, thereby forming pairs of radially aligned apertures which permit liquid in the endless conduit 36 to be expelled from the disk toy 10 by centrifugal force from spinning motion during flight. It will be seen from FIG. 2 that none of the radially extending conduits 34 are aligned with the outlet apertures 40 and 30, thereby forcing liquid in the endless conduit to be evenly distributed thereabout.

Figure 4:
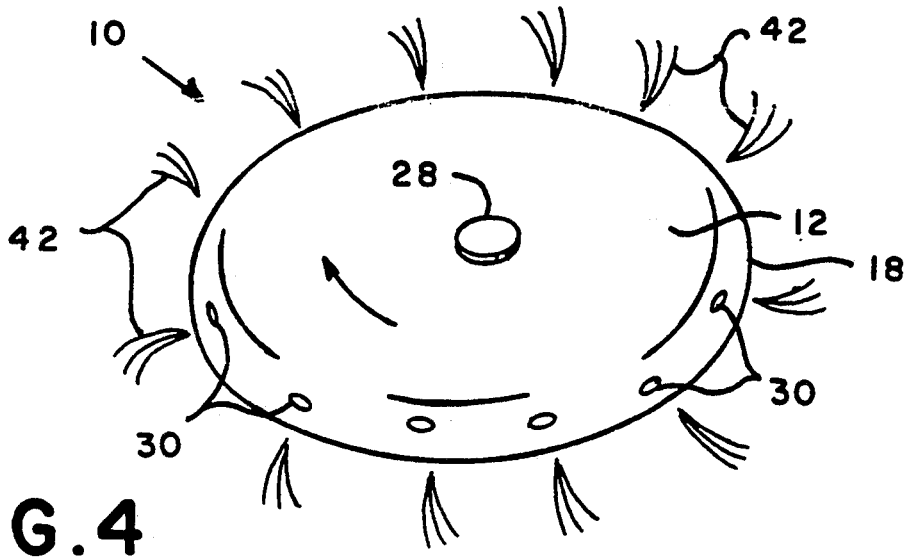
FIG. 4 is a perspective view drawn to a reduced scale illustrating the approximate pattern of liquid being expelled from the disk toy during flight.

The operation of the disk toy 10 is very simple and is essentially the same as with any type of flying disk such as the FRISBEE TM mentioned above. Basically, the disk toy 10 is vigorously thrown with a simultaneous back hand motion and flip of the wrist so as to impart a spinning motion to the disk toy as it is projected forwardly and upwardly in a flight pattern. During this motion, the centrifugal force imposed on the liquid in the reservoir from the spinning motion of the disk toy causes the liquid therein to pass through the radially extending conduits 34 and into and around the endless conduit 36, then out through the aligned apertures 40 and 30 in the endless conduit 36 and annulus 18 respectively in a pattern somewhat as indicated by the individual liquid patterns 42 in FIG. 4.

What we claim and desire to secure by Letters Patent is:

1. A flying disk toy adapted to spray a stored liquid into the air as the toy traverses a flight pattern after having been vigorously thrown with a spinning motion imparted thereto, said toy comprising:

A. a relatively flat, circular, disk shaped body member having opposite faces,

B. an axially curved annulus surrounding said body member and defining a peripheral space therewith, C. means defining a reservoir for holding a quantity of liquid, said reservoir having a peripheral boundary substantially smaller than said body member and being disposed centrally on the face of said body member surrounded by said annulus, D. a plurality of outlet means disposed in spaced relationship substantially continuously around said curved annulus and extending through said annulus for permitting liquid to pass through said curved annulus in response to centrifugal force imposed on the liquid in said reservoir defining means from the spinning motion of said body member, and E. conduit means disposed on said face of said body member and defining a liquid distribution system for permitting liquid to flow unimpeded from said reservoir defining means to said outlet means in response to said centrifugal force generated by rotation of the disk toy, thereby distributing liquid stored in said reservoir defining means to said outlet means, whereby liquid is expelled from said outlet means in a circular pattern while the disk toy traverses the flight pattern.

2. A flying disk toy as set forth in claim 1 wherein said liquid distribution system comprises an endless conduit disposed in the space defined by said curved annulus, and means communicating between said reservoir defining means and said endless conduit.

3. A flying disk toy as set forth in claim 2 wherein said means communicating between said reservoir defining means and said endless conduit comprises a plurality of radially extending conduits connected to said reservoir defining means and said endless conduit.

4. A flying disk toy as set forth in claim 3 wherein said outlet means comprises a plurality of pairs of aligned apertures disposed in said endless conduit and said annulus.

* * * * *